US005081894A

United States Patent [19]

Paige

[11] Patent Number: 5,081,894

[45] Date of Patent: Jan. 21, 1992

[54] CAPO

[76] Inventor: Bryan R. Paige, 3016 Sand Dune, Hillsdale, Mich. 49242

[21] Appl. No.: 540,287

[22] Filed: Jun. 18, 1990

[51] Int. Cl.[5] ..... G10D 3/00

[52] U.S. Cl. ..... 84/318

[58] Field of Search ..... 84/318

[56] References Cited

U.S. PATENT DOCUMENTS

| | | | |
|---|---|---|---|
| D. 257,988 | 1/1981 | Nakamoto | D17/20 |
| D. 281,508 | 11/1985 | McKinney, III | D17/20 |
| 583,102 | 5/1897 | Utt | 84/318 |
| 608,278 | 8/1898 | Benson | 84/318 |
| 656,904 | 8/1900 | Pletcher | 84/318 |
| 775,399 | 11/1904 | Halladay | 84/318 |
| 1,007,960 | 11/1911 | Moore | 84/318 |
| 3,504,589 | 4/1970 | Wowries | 84/318 |
| 4,104,947 | 8/1978 | Oster | 84/318 |
| 4,149,443 | 4/1979 | Bringe | 84/318 |
| 4,250,790 | 2/1981 | Shubb et al. | 84/318 |
| 4,503,747 | 3/1985 | Labbe | 84/318 |
| 4,621,558 | 11/1986 | Cornette | 84/318 |

FOREIGN PATENT DOCUMENTS

| | | | |
|---|---|---|---|
| 22474 | 12/1905 | Austria | 84/318 |

OTHER PUBLICATIONS 2 pictures of Banjo Capo Manufactured by Golden Gate Musical Instruments No Address on Package dated before 6/18/90, Model BC-10.

1 Picture of Capo Manufactured by Sabine Muscial Manufacturing Co., Inc.—505 Northwest 13th St. Gainesville Fla., dated before 6/18/90.

1 Picture of Guitar Capo Manufactured by Golden Gate Musical Instruments—San Francisco, Calif., Model GC-8, dated before 6/18/90.

1 Picture of Kyser Guitar Capo manufactured by Kyser Capo Co. Box 210705—Dallas Tex., dated before 6/18/90.

1 Picture of Shubb Capo Manufactured by Shubb Capos, Oakland Calif.

*Primary Examiner*—Brian W. Brown

*Attorney, Agent, or Firm*—Peter D. Keefe

[57] ABSTRACT

A capo composed of a semi-circular yoke, a bar pivotally connected at a first end to a first fork of the yoke and releasably interlocked at the second end to a second fork of the yoke via intermeshing of opposing slots oriented at ninety degrees to each other, a clasp mechanism located on the second fork for releasably locking onto the second end of the bar, a screw operated foot connected with the yoke, and dual guide bars connected at either side of the foot which movably engage slots located in the yoke. The capo provides for a simultaneous compressive force being applied to each of the strings of the instrument fretboard because the bar is connected with respect to the yoke and the foot at an angle so that it will engage the strings uniformly and simultaneously as the screw is tightened.

18 Claims, 2 Drawing Sheets

CAPO

BACKGROUND OF THE INVENTION

1. Field of the Invention

The present invention relates to capos, and more particularly to an improved capo which is adapted for providing maximum performance with respect to the musical instrument to which it is connected.

2. Description of the Prior Art

Capos are used in connection with stringed instruments, such as guitars, banjos, ukuleles and the like, which have a neck-like fretboard on which the strings are played. The capo is a clamp device which fits on the instrument neck and is used to selectively clamp upon the strings of the fretboard so as to alter the effective length of vibration of the strings. The purpose of the capo is to allow for selective alteration of the tonality of the strings without affecting the original tuning of the strings of the instrument. Thus, by placing the capo at a pre-selected location on the fretboard, a musican can play his/her instrument and produce a desired sound quality, since the pitch produced by the strings with the capo attached is different from the pitch produced by the stings with the capo absent.

In the prio art there are a number of capo structures. Each of these is basically a clamp type of device in which a bar is caused to press transversely across the strings by operation of an adjustable clamping mechanism that interacts with the underside of the fretboard. Examples of prior art capos are as follows.

U.S. Pat. No. 608,278 to Benson, dated Aug. 2, 1898, discloses a capo having a generally U-shaped main body, a bar connected to the upper portion of the main body for transversely contacting the fretboard strings, a foot for pressing against the underside of the fretboard, a screw operated clamping mechanism and a guide finger interconnected with the foot and the lower portion of the main body for keeping the foot from turning when the screw of the screw operated clamping mechanism is rotated to effect clamping of the bar onto the strings.

U.S. Pat. No. 656,904 to Pletcher, dated Aug. 28, 1900, discloses a capo having a bar for pressing transversely against the strings, a clasp member pivotally connected to the bar, an arm member connected to one end of the bar, and a spring steel clip pivotally connected with the arm and which is structured to selectively engage the clasp member.

U.S. Pat. No. 775,399 to Halladay, dated Nov. 22, 1904, discloses a capo having a bar for transversely engaging the strings, an arm connected to the bar, and a screw actuated lever clamp pivotally interconnected with the arm.

U.S. Pat. No. 1,007,960 to Moore, dated Nov. 7, 1911, discloses a capo having a bar for transversely contacting the strings, a rod pivotally connected at either side of the bar, and a screw operated foot pivotally connected to the free ends of the rods.

U.S. Pat. No. 4,104,947 to Oster, dated Aug. 8, 1978, discloses a capo having a U-shaped member of which the upper portion thereof serves as a bar for transversely engaging the strings, two off-set resilient string engaging members, a screw operated clamping mechanism connected with the lower portion of the U-shaped member and a foot interconnected with the clamping mechanism and a central portion of the U-shaped member.

U.S. Pat. No. 4,250,790 to Shubb et al, dated Feb. 17, 1981, discloses a capo having a bar with a resilient material for transversely contacting the strings, an arm connected to the bar, a curved jaw pivotally connected to the arm for contacting the underside of the fretboard, a lever pivotally connected to the arm in spaced relation with respect to the curved jaw, and a screw mechanism interconnected with the lever. Applicant believes this form of capo to be presently the most popular among musicians.

U.S. Pat. Des. No. 257,988 to Nakamoto, dated Jan. 20, 1981, discloses an ornamental design for a capo showing a yoke having a pivotally connected bar for transversely contacting the strings, a releasable clasp mechanism for holding the bar in fixed relation to the yoke, and a screw operated clamp mechanism which includes a foot for contacting the underside of the fretboard and guide rods for preventing the foot from rotating when the screw is rotated.

U.S. Pat. Des. No. 281,508 to McKinney, III, dated Nov. 26, 1988, discloses an ornamental design for a capo showing a yoke having a pivotally connected bar for transversely contacting the strings, a releasable clasp mechanism for holding the bar in fixed relation to the yoke, and a screw operated clamp mechanism which includes a foot for contacting the underside of the fretboard and a guide member for preventing the foot from rotating when the screw is rotated.

While each of the foregoing examples of capos accomplish their task in more-or-less acceptable fashion, there remains in the art the followin problems.

Each of the strings on the fretboard are of varying thickness, so that when the bar of the capo clamps down on the strings, the thicknest of the strings will be more pressably affected than the thinnest of the strings. While the use of a compressive material on the bar may allow for compressible engagement with the strings and thus to some degree mollify this problem (as pointed out particularly by Oster), there yet remains the problem that each of the strings is subjected to varying levels of compressive force, as prior art capos are structured to align the bar parallel with the surface of the fretboard.

Capos are of value because of the precision with which they may be placed upon the fretboard, which placement is predicated upon precise alignment of the component parts thereof. There remains in the prior art the problem that if the capo is subjected to accidental shock while being handled or transported, misalignment of the components could ensue.

So too, capos are of value because they are capable of being placed upon the strings in a true transverse orientation with respect thereto. In this regard, what is yet needed is a capo which has provision for guidance between the yoke and the foot which assures that play is absolutely minimized between the foot, the yoke and the bar, yet the operation of the foot and bar are fully unencumbered thereby.

SUMMARY OF THE INVENTION

The present invention is a capo which is structured to be easily operated, provide precise transverse string alignment, be substantially impervious to shock, and provide an equal compressive force on each of the strings of an instrument fretboard.

The present invention is composed of an arcuate yoke, a bar pivotally connected to one end of the yoke, a clasp mechanism at the other end of the yoke in which the bar and the yoke interconnect via notches oriented at ninety degrees to each other, a screw operated foot connected with the yoke, and dual guide bars connected with the foot which movably engage slots located in the yoke.

Operation of the capo according to the present invention is simplified by the ease of operation of the screw mechanism and the ease by which the clasp mechanism engages the bar. Precise transverse string alignment is provided by the precise pre-aligned interrelationship between the foot, the yoke and the bar primarily because of the guide bar structure. The capo according to the present invention is substantially impervious to shock because both the bar and the yoke are provided with mutually interlocking notches which prevent the bar from being displaced with respect to the yoke in the event an untoward accident should occur. Finally, the capo according to the present invention provides for an equal compressive force being applied to each of the strings because the bar is connected with respect to the yoke and the foot so that it will engage the strings uniformly and simultaneously as the screw is tightened.

Accordingly, it is an object of the present invention to provide a capo which is easy to operate, yet provides for precise alignment upon the fretboard of a stringed instrument.

It is yet another object of the present invention to provide a capo which provides a uniform compressive force upon each string of the fretboard by simultaneously engaging each string as it is clamped onto the fretboard.

It is still another object of the present invention to provide a capo which is impervious to accidental shock, in that the component parts interlock in a manner that will not allow for misalignment in the event of an untoward impact during handling or transportation.

It is an additional object of the present invention to provide a capo in which guidance between the foot and the yoke is extremely precise.

These, and additional objects, advantages, features and benefits of the present invention will become apparent from the following specification.

DETAILED DESCRIPTION OF THE PREFERRED EMBODIMENTS

Figure 1:
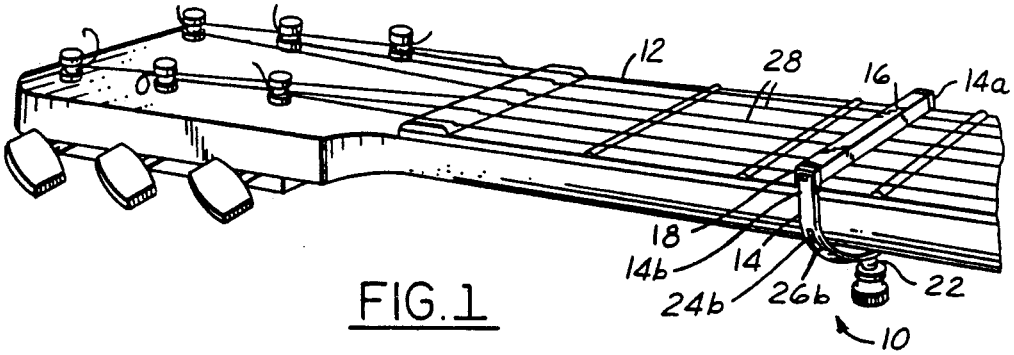
FIG. 1 is a perspective view of the capo according to the present invention, shown in operation on the fretboard of a guitar.
Figure 2:
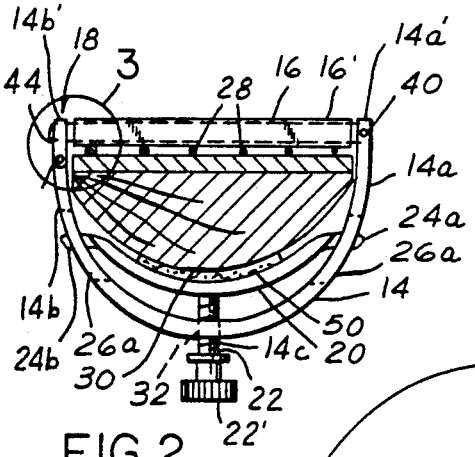
FIG. 2 is a side view of the capo according to the present invention, shown in operation with the fretboard of a guitar depicted in cross-section.

Referring now to the Drawing, FIGS. 1 and 2 show generally the capo 10 according to the present invention in operation on the fretboard 12 of a stringed instrument. The capo 10 is composed generally of a yoke 14 having a semi-circular arcuate shape forming two forks **14*a* and 14*b* between an apex 14*c*, a bar 16 which is pivotally connected to one fork 14*a* of the yoke 14, a clasp mechanism 18 attached to the other fork 14*b* for releasably connecting the bar 16 to the yoke 14, a foot 20, a screw member 22 connected to the yoke 14 at its apex 14*c* and also connected to the foot 20, and a guide member 24*a* and 24*b* respectively connected to each side of the foot 20 for providing slidable guidance along a respective slot 26*a* and 26*b* in each of the forks 14*a* and 14*b***.

As can be seen from reference to FIGS. 1 and 2, the bar 16 is structured to extend transversely across the strings 28 of the fretboard 12. By applying force onto the strings, the strings are forced between the bar and the fretboard, thereby effectively changing the vibration length of the strings. The compressional force of the bar 16 onto the strings 28 is provided by the foot 20 being squeezed against the back 30 of the fretboard through operation of the screw member 22, which simultaneously causes the yoke 14 to slide with respect to the foot until the bar applies a desired compressional force upon the strings.

The yoke 14 is preferred to be constructed of stainless steel and is dimensioned to generally fit about the neck portion of the fretboard of a standard stringed musical instrument, as exemplarily shown in FIG. 1. The yoke is further preferred to have a general semi-circular curvalinear arcuate shape which is modified to have locally linear segments at the yoke apex **14*c*, and adjacent each end 14*a*' and 14*b*' of the forks 14*a* and 14*b*, respectively. The yoke apex 14*c* of the yoke has a threaded aperture 32 through which the screw member 22 threads. A center portion of each fork 14*a* and 14*b* is provided with a slot 26*a* and 26*b***, respectively.

The bar 16 is preferred to be constructed of stainless steel and have a generally square cross-section. The bar is sufficiently long to span the distance between the forks **14*a* and 14*b*. It is further preferred to cover all but the ends of the bar 16 with a resilient polymer material 16' which is intended to resiliently engage the strings 28**.

Figure 10:
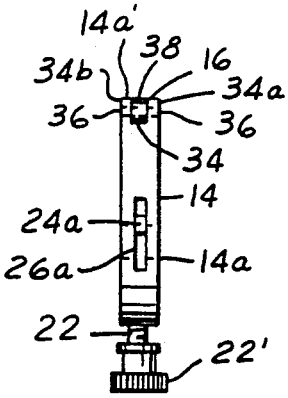
FIG. 10 is an end view of the capo according to the present invention, detailing the yoke slot and guide bar structural interrelationship.

Fork end **14*a*' is provided with a notch 34 into which a first end of the bar 16 inserts (as best seen in FIG. 10). An aperture 36 is provided in the flanges 34*a* and 34*b* formed by the notch 34, and an aperture 38 is provided in a first end of the bar 16. A pin 40 resides in the apertures 36 and 38, thereby providing a pivotal attachment of the bar 16 to the yoke 14**.

Figure 3:
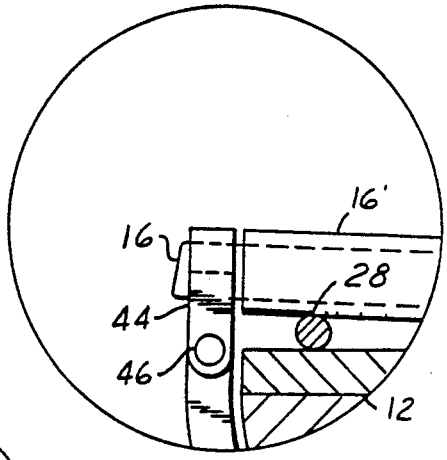
FIGS. 3 through 5 show a detail view of the clasp mechanism of the capo according to the present invention, per circle 3 of FIG. 2, showing the clasp mechanism at different stages of operation.
Figure 4:
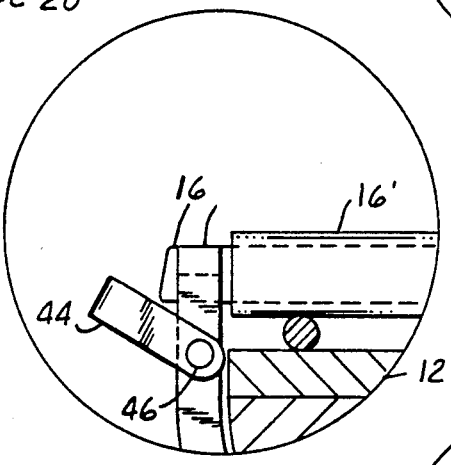
Figure 5:
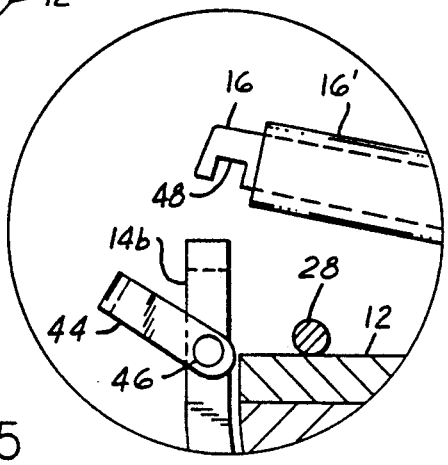
Figure 6:
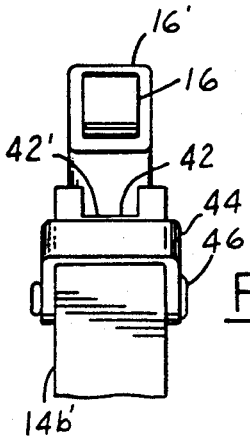
FIG. 6 is an end view of the capo according to the present invention, showing the clasp mechanism in the stage of operation depicted in FIG. 5.

Fork end **14*b*' is provided with a notch 42 (as best seen in FIG. 6) into which the second end of the bar 16 inserts. A U-shaped clasp 44 is pivotally connected by a pin 46 located adjacent fork end 14*b*'. As can best be seen by review of FIGS. 5 and 6, the second end of the bar 16 is provided with a notch 48 which is at right angle to the notch 42 in the fork end 14***b*'. The notches 42 and 48 are dimensioned and located so as to mutually engage one another when the second end of the bar 16 is placed against the fork end 14*b*'. When the bar is in this position, as shown in FIG. 4, the clasp 44 may be rotated up over the second end of the bar 16, as shown in FIG. 3. The combination of the notches 42 and 48 and the clasp 44 form the clasping mechanism 18 referred to above.

After the second end of the bar 16 has been rotated on the pivot at pin 40 (as shown in FIG. 5) so that notch 42 on the fork end 14*b*' interlocks with notch 48 on the second end of the bar 16 (as shown in FIG. 4) and the clasp 44 has been rotated on pin 40 so that it engages the second end of the bar 16 (as shown in FIG. 3), the following advantageous mechanical features are achieved. Firstly, neither fork can be displaced away from or toward the other because the two notches 42 and 48 abut each other in these directions of potential movement; thus, the shape of the yoke is virtually impervious to shock caused by mishandling or accidents in transportation. Secondly, the bar 16 is held affixed in true alignment with respect to the two forks 14*a* and 14*b* because the two notches 42 and 48 abut each other in all directions of potential movement of the bar, and also because the first end of the bar abuts the notch 34 and is pinned thereat, as well. Accordingly, the precise mechanical interrelationship of the yoke and bar components of the capo 10 are assured to be in a continually aligned configuration.

An important feature of the present invention is provision for the bar 16 to engage the strings 28 simultaneously as the screw member 22 effects clamping of the bar 16 onto the fretboard 12. This is achieved in one of two ways.

Figure 8:
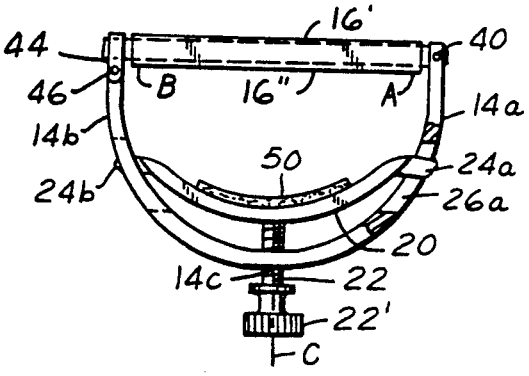
FIG. 8 is a side view of the capo according to the present invention showing a second preferred embodiment in which the bar is mounted upon the yoke at an angle other than 90 degrees relative to the normal of the apex of the yoke.

A first preferred way is shown in FIG. 8, in which the bar 16 has a constant cross-section along its length, but the floor 42' of notch 42 is located relative to pin 40 such that the location A on the resilient bar covering 16' is slightly closer to yoke apex 14*c* than is location B. In other words, the bottom surface 16'' of the resilient bar covering 16' is at other than 90 degrees with respect to an imaginary normal C of the yoke apex 14*c*. This translates into location A being closer to the fretboard than location B as the bar 16 is being clamped onto the fretboard. However, the thickest of the strings 28 is adjacent location B and the thinnest strings are adjacent location A. Accordingly, the resilient bar covering 16' is actually everywhere uniformly spaced above the strings 28 as the bar is clamped onto the fretboard.

Figure 7:
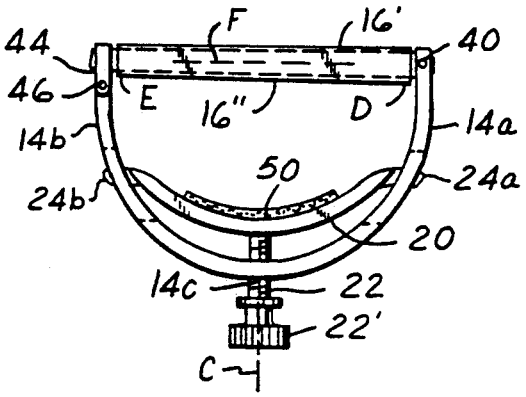
FIG. 7 is a side view of the capo according to the present invention showing a first preferred embodiment in which the bar has a variable thickness.

A second preferred way is shown in FIG. 7, in which the floor 42' of notch 42 is positioned relative to pin 40 so that the centerline F of the bar 16 is perpendicular with respect to the imaginary normal C of the yoke apex 14*c*, however the bar is now of a smoothly non-uniform cross-section, so that it is thicker at location D than it is at location E. In other words, the bottom surface 16'' of the resilient bar covering 16' is at other than 90 degrees with respect to the imaginary normal C of the yoke apex 14*c*. This translates into location D being closer to the fretboard than is location E as the bar is clamped onto the fret board. Again, however, the thickest of the strings 28 is adjacent location E and the thinnest strings are adjacent location D. Accordingly, the resilient bar covering 16' is actually everywhere uniformly spaced above the strings 28 as the bar is clamped onto the fretboard.

The foot 20 is preferred to be constructed of stainless steel and has a generally curvalinear shape which is intended to substantially conform to the backside 30 of the instrument fretboard 12. It is further preferred to provide a resilient interface pad 50 on the foot for purposes of actually contacting the delicate backside 30, so that marring will not be risked. A suitable and preferred material for the pad 50 is leather.

As indicated hereinabove, the yoke apex 14*c* of the yoke is provided with a threaded aperture 32. A screw member 22 threads through the threaded aperture 32 and terminates at the foot 20. The connection of the screw member 22 to the foot 20 is such that the screw member may freely turn in relation to the foot, yet the foot must linearly travel captively with the screw member as the screw member is rotated in relation to the yoke. It is preferred to include a knurled knob 22' on the end of the screw member to facilitate rotation thereof. It is further preferred to construct the screw member 22 of brass so that any wear will be occasioned upon the screw member rather than the yoke 14.

The foot 20 is guided at either side by guide members 24*a* and 24*b*, and it is preferred that the guide members be integrally connected with the foot and constructed of stainless steel, too. Each guide member extends from the foot 20 to a respective slot 26*a* and 26*b* in the central portion of the yokes 14*a* and 14*b*. The slots 26*a* and 26*b* are precisely aligned to extend along a centerline of the yokes, the centerline being defined by the center of the threaded aperture 32 and the mid-point of the notches 34 and 42. The length of the slots 26*a* and 26*b* is determined by the linear travel distance of the foot needed to ensure easy and efficient use of the capo 10 with the fretboard 12. Because the guide members engage the slots 26*a* and 26*b* at either extreme end of the foot, a maximum degree of torque control is achieved, resulting in virtual elimination of the possibility of the foot twisting as the screw member 22 is turned while effecting clamping of the capo 10 onto the fretboard 12. Accordingly, a high degree of precision can be expected in the final positioning of the capo along the strings 28, a result that is all important to the musician.

Operation of the capo 10 according to the present invention will now be described.

With the bar 16 in a pivoted up position, the musician places the capo 10 onto the fretboard 12 and then positions it where he/she wishes the strings to be engaged. Thereupon, the bar is pivoted downwardly so that the bar contacts fork end 14*b*' and the notches 42 and 48 interlock. Next, the clasp 44 is rotated so that it engages the bar. A final positioning of the bar is then made as the knurled knob is rotated causing the foot to linearly move away from the yoke apex 14*c*, causing the resilient covering 16' of the bar 16 to commence being compressibly forced onto each of the strings 28. The knurled knob is then further rotated to tighten the bar onto the strings, and playing of the instrument my thereupon commence. Removal of the capo 10 from the fretboard is effected by reversing the steps hereinabove recounted.

Figure 9:
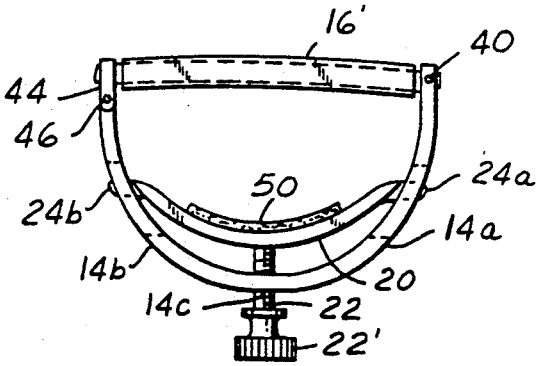
FIG. 9 is a side view of the capo according to the present invention showing a third preferred embodiment in which the bar is mounted upon the yoke at an angle other than 90 degrees relative to the normal of the apex of the yoke and the bar is curved to fit a curved fretboard.

FIG. 9 shows a variation encompassed by the scope of the present invention in which the bar may be structured to include a curve so as to conform to curved fretboards, yet retain all of the features hereinabove described, the bar being depicted exemplarily operative in the mode delineated by FIG. 8.

To those skilled in the art to which this invention appertains, the above described preferred embodiment may be subject to change or modification. For instance, the curved bar of FIG. 9 could also be operative in the mode delineated in FIG. 7. Such change or modification can be carried out without departing from the scope of the invention, which is intended to be limited only by the scope of the appended claims.

What is claimed is:

1. A capo for a musical instrument having a fretboard with a plurality of strings, said capo comprising:

a yoke, said yoke being substantially semi-circular in shape, said yoke having an apex, said yoke forming a first fork on one side of said apex and a second fork on the other side of said apex, said first fork terminating at a first fork end, said second fork terminating at a second fork end, said first fork having a first guide slot, said second yoke having a second guide slot;

a bar having a first end and a second end, said first end of said bar being pivotally connected with said first fork end;

clasp means connected to said yoke adjacent said second fork end for releasably locking said bar onto said second fork end;

a foot having a first end and a second end;

tightening means connected with said yoke at said apex and also connected to said foot for selectively moving said foot toward said bar and away from said apex;

a first guide member connected to said first end of said foot, said first guide member extending through said first guide slot for guiding said foot; and a second guide member connected to said second end of said foot, said second guide member extending through said second guide slot for guiding said foot.

2. The capo of claim 1, wherein said second fork has a first notch; wherein further said bar has a second notch at said second end thereof, said second notch being oriented at ninety degrees relative to said first notch, said first notch and said second notch being dimensioned to interlockingly receive one another when said second end of said bar is pivoted so as to contact said second fork end.

3. The capo of claim 2, wherein said bar has a lower edge facing toward said apex, said lower edge being angled at other than ninety degrees relative to an imaginary normal to said apex when said second end of said bar contacts said second fork end; wherein when said tightening means causes said foot and said bar to press against opposite sides of the musical instrument fretboard, said bar will simultaneously engage the strings.

4. The capo of claim 3, wherein said foot has a concavely curved surface facing toward said lower edge of said bar; said foot further comprising a resilient pad attached to said concavely curved surface.

5. The capo of claim 4, further comprising a resilient material covering said bar.

6. The capo of claim 5, wherein said yoke, said bar, said foot, said first guide member and said second guide member are each constructed of stainless steel.

7. The capo of claim 6, wherein said yoke is shaped so as to have locally linear segments, said locally linear segments being located at said apex, adjacent said first fork end and adjacent said second fork end.

8. A capo for a musical instrument having a fretboard with a plurality of strings, said capo comprising:

a yoke, said yoke being substantially semi-circular in shape, said yoke having an apex, said yoke forming a first fork on one side of said apex and a second fork on the other side of said apex, said first fork terminating at a first fork end, said second fork terminating at a second fork end, said second fork end having a first notch;

a bar having a first end and a second end, said first end of said bar being pivotally connected with said first fork, said bar having a second notch at said second end thereof, said second notch being oriented at ninety degrees relative to said first notch, said first notch and said second notch being dimensioned to interlocking receive one another when said second end of said bar is pivoted so as to contact said second fork end;

clasp means connected with said yoke adjacent said second fork end for releasably locking said second end of said bar onto said second fork end when said first notch interlocks with said second notch;

a foot;

tightening means connected with said yoke at said apex and connected to said foot for selectively moving said foot toward said bar and away from said apex; and guide member means connected to said foot and said yoke for guiding said foot; wherein said foot has a first end and a second end; further wherein said guide member means comprises:

a first guide slot located in said first fork;

a second guide slot located in said second fork;

a first guide member connected to said first end of said foot, said first guide member extending through said first guide slot for guiding said foot; and a second guide member connected to said second end of said foot, said second guide member extending through said second guide slot for guiding said foot;

wherein said bar has a lower edge facing toward said apex, said lower edge being angled at other than ninety degrees relative to an imaginary normal to said apex when said second end of said bar contacts said second fork end; wherein when said tightening means causes said foot and said bar to press against opposite sides of the musical instrument fretboard, said bar will simultaneously engage the strings.

9. The capo of claim 8, wherein said foot has a concavely curved surface facing toward said lower edge of said bar; said foot further comprising a resilient pad attached to said concavely curved surface.

10. The capo of claim 9, further comprising a resilient material covering said bar.

11. The capo of claim 10, wherein said yoke, said bar, said foot, said first guide member and said second guide member are each constructed of stainless steel.

12. The capo of claim 11, wherein said yoke is shaped so as to have locally linear segments, said locally linear segments being located at said apex, adjacent said first fork end and adjacent said second fork end.

13. A capo for a musical instrument having a fretboard with a plurality of strings, said capo comprising;

a yoke, said yoke being substantially semi-circular in shape, said yoke having an apex, said yoke forming a first fork on one side of said apex and a second fork on the other side of said apex, said first fork terminating at a first fork end, said second fork terminating at a second fork end;

a bar having a first end and a second end, said bar being pivotally connected at said first end with said first fork, said bar having a lower edge facing toward said apex; said lower edge being angled at other than ninety degrees relative to said apex when said second end of said bar contacts said second fork of said yoke;

clasp means connected with said second fork for releasably locking said bar onto said second fork when said second end of said bar contacts said second fork;

a foot;

tightening means connected with said yoke at said apex and connected to said foot for selectively moving said foot toward said bar and away from said apex; and guide member means connected to said foot and said yoke for guiding said foot; wherein said foot has a first end and a second end; further wherein said guide member means comprises:

a first guide slot located in said first fork;

a second guide slot located in said second fork;

a first guide member connected to said first end of said foot, said first guide member extending through said first guide slot for guiding said foot; and a second guide member connected to said second end of said foot, said second guide member extending through said second guide slot for guiding said foot.

14. The capo of claim 13, wherein said second yoke end has a first notch; wherein further said second end of said bar has a second notch, said second notch being oriented at ninety degrees relative to said first notch, said first notch and said second notch being dimensioned to interlockingly receive one another when said second end of said bar is pivoted so as to contact said second fork end.

15. The capo of claim 14, wherein said foot has a concavely curved surface facing toward said lower edge of said bar; said foot further comprising a resilient pad attached to said concavely curved surface.

16. The capo of claim 15, further comprising a resilient material covering said bar.

17. The capo of claim 16, wherein said yoke, said bar, said foot, said first guide member and said second guide member are each constructed of stainless steel.

18. The capo of claim 17, wherein said yoke is shaped so as to have locally linear segments, said locally linear segments being located at said apex, adjacent said first fork end and adjacent said second fork end.

* * * * *